US011199799B2

(12) United States Patent
Itagaki

(10) Patent No.: US 11,199,799 B2
(45) Date of Patent: Dec. 14, 2021

(54) IMAGE FORMING APPARATUS

(71) Applicant: CANON KABUSHIKI KAISHA, Tokyo (JP)

(72) Inventor: Tomohisa Itagaki, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/902,625

(22) Filed: Jun. 16, 2020

(65) Prior Publication Data

US 2020/0409298 A1 Dec. 31, 2020

(30) Foreign Application Priority Data

Jun. 28, 2019 (JP) ..... JP2019-121631

(51) Int. Cl.
*G03G 15/00* (2006.01)
*G03G 15/01* (2006.01)

(52) U.S. Cl.
CPC ..... *G03G 15/5041* (2013.01); *G03G 15/0131* (2013.01); *G03G 15/5054* (2013.01); *G03G 2215/00679* (2013.01)

(58) Field of Classification Search
None
See application file for complete search history.

(56) References Cited

U.S. PATENT DOCUMENTS

| | | | | |
|---|---|---|---|---|
| 6,959,157 | B2 | 10/2005 | Nakayama | |
| 7,509,065 | B2 | 3/2009 | Itagaki | |
| 10,484,555 | B2 | 11/2019 | Itagaki | |
| 2018/0341208 | A1* | 11/2018 | Nakamura | G01J 3/524 |

FOREIGN PATENT DOCUMENTS

| | | | |
|---|---|---|---|
| JP | 11-75067 | A | 3/1999 |
| JP | 2009-115690 | A | 5/2009 |

* cited by examiner

*Primary Examiner* — Jas A Sanghera
(74) *Attorney, Agent, or Firm* — Venable LLP

(57) ABSTRACT

An image forming apparatus includes an image forming unit (LBP) to form an image on a sheet, a conveyance unit configured to convey the sheet, a sensor, which is configured to move in a direction perpendicular to a conveying direction in which the conveyance unit conveys the sheet, and to read the image on the sheet, and a controller. The image forming unit forms a first trigger image and a first pattern image on the sheet, and the image forming unit forms a second trigger image and a second pattern image at a position on the sheet different from a position of both the first trigger image and the first pattern image in the conveying direction. A formation area of the first trigger image in the direction perpendicular to the conveying direction overlaps with a formation area of the second pattern image.

14 Claims, 8 Drawing Sheets

IMAGE FORMING APPARATUS

BACKGROUND OF THE INVENTION

Field of the Invention

The present disclosure relates to technology for improving quality of an image formed by an image forming apparatus.

Description of the Related Art

An on-demand image forming apparatus (hereinafter referred to as "printer") has been remarkably improved in image quality and productivity with remarkable reduction in cost, and is entering the offset printing market. However, the use of a printer for offset printing is limited due to a high image quality level of the offset printing. Further expansion of the printer market requires image quality equivalent to or higher than that of the offset printing. Particular importance is placed on improvement in comprehensive evaluation value of, for example, image quality stability, tone characteristics, color reproduction range, and color matching performance, namely, "color reproducibility".

There have been various proposals made to improve color reproducibility. In Japanese Patent Application Laid-open No. Hei 11-75067, there is proposed a technology in which image density of an image formed on a recording material is detected by a reader of a copying machine, and image forming conditions are corrected based on a result of the detection, to thereby correct the image density. In each of U.S. Pat. Nos. 7,509,065 (B2) and 6,959,157 (B2), there is proposed a technology in which a sensor of an in-line system (in-line sensor) configured to detect image density of an image formed on a recording material being conveyed is provided, and image forming conditions are corrected based on a result of the detection, to thereby correct the image density. In the image forming apparatus of U.S. Pat. No. 7,509,065 (B2), an RGB sensor is incorporated as an in-line sensor. In the image forming apparatus of U.S. Pat. No. 6,959,157 (B2), a spectral reflectance sensor having a wider reading range and higher accuracy than those of the RGB sensor is incorporated as the in-line sensor. Those sensors detect the image density by, for example, irradiating the recording material with light and receiving the reflected light. Therefore, the sensors cannot detect the image density with high accuracy when the recording material being conveyed flutters. In Japanese Patent Application Laid-open No. 2009-115690, there is proposed an image forming apparatus provided with a configuration for moving a sensor in a direction (main scanning direction) perpendicular to a conveying direction of a recording material and configured to correct image density of an image formed on the recording material by detecting the image density and correcting image forming conditions.

The image forming conditions for improving color reproducibility include creation and correction of an ICC profile or another such multi-order color conversion profile, tone correction of a primary color, highest density correction, secondary transfer voltage correction, and main scanning unevenness correction. The image forming apparatus can automatically adjust those items of conditions through use of the in-line sensor.

In the case of correcting the image forming conditions, an image for detection, which is formed of a plurality of patch images, is detected by the sensor. In order to control timings to detect the plurality of patch images, the image for detection includes a patch image (hereinafter referred to as "trigger bar") serving as a reference. In a case where the trigger bar is arranged at an end portion in the main scanning direction, unevenness at the arrangement position (main scanning unevenness) cannot be detected. This causes a decrease in accuracy of main scanning unevenness correction at the end portion in the main scanning direction. The main scanning unevenness is unevenness in image density caused by uneven light distribution in a case where a photosensitive member is exposed.

In addition, at the time of detection of the image for detection, a streak may occur in a detection result of the image for detection ascribable to local or temporary foreign particles. In this case, an appropriate correction value for main scanning unevenness cannot be acquired from the detection result. Therefore, up to now, the detection result in which the streak has occurred is deleted, and a correction value is generated by performing interpolation calculation from detection results of the adjacent patch images. However, in a case where an interval between the patch images is large in the main scanning direction, a large correction error is produced, and it is thus difficult to perform the highly accurate correction. Accordingly, it is an object of the present disclosure to provide an image forming apparatus capable of correcting image forming conditions with high accuracy.

SUMMARY OF THE INVENTION

An image forming apparatus according to the present disclosure includes: an image forming unit configured to form an image on a sheet based on an image forming condition; a conveyance unit configured to convey the sheet; a sensor, which is configured to move in a direction perpendicular to a conveying direction in which the conveyance unit conveys the sheet, and to read the image on the sheet; and a controller configured to: control the image forming unit to form a first trigger image and a first pattern image on the sheet, the first trigger image being used for controlling a timing to read the first pattern image in the direction perpendicular to the conveying direction; control the image forming unit to form a second trigger image and a second pattern image at a position on the sheet different from a position of both the first trigger image and the first pattern image in the conveying direction, the second trigger image being used for controlling a timing to read the second pattern image in the direction perpendicular to the conveying direction; control the conveyance unit to convey the sheet; control, in a first scan in which the first trigger image and the first pattern image are read, the sensor to move in a first direction perpendicular to the conveying direction; control, in a second scan in which the second trigger image and the second pattern image are read, the sensor to move in a second direction opposite to the first direction perpendicular to the conveying direction; and generate the image forming condition based on a reading result obtained by the sensor, wherein the first trigger image is formed on upstream of the first pattern image in the first direction, wherein a formation area of the first trigger image in the direction perpendicular to the conveying direction overlaps with a formation area of the second pattern image in the direction perpendicular to the conveying direction, wherein the second trigger image is formed on upstream of the second pattern image in the second direction, and wherein a formation area of the second trigger image in the direction perpendicular to the conveying direction overlaps with a formation area of the first pattern image in the direction perpendicular to the conveying direction.

Further features of the present invention will become apparent from the following description of exemplary embodiments (with reference to the attached drawings).

DESCRIPTION OF THE EMBODIMENTS

Now, at least one embodiment of the present disclosure is described in detail with reference to the drawings.

<Image Forming Apparatus>

Figure 1:
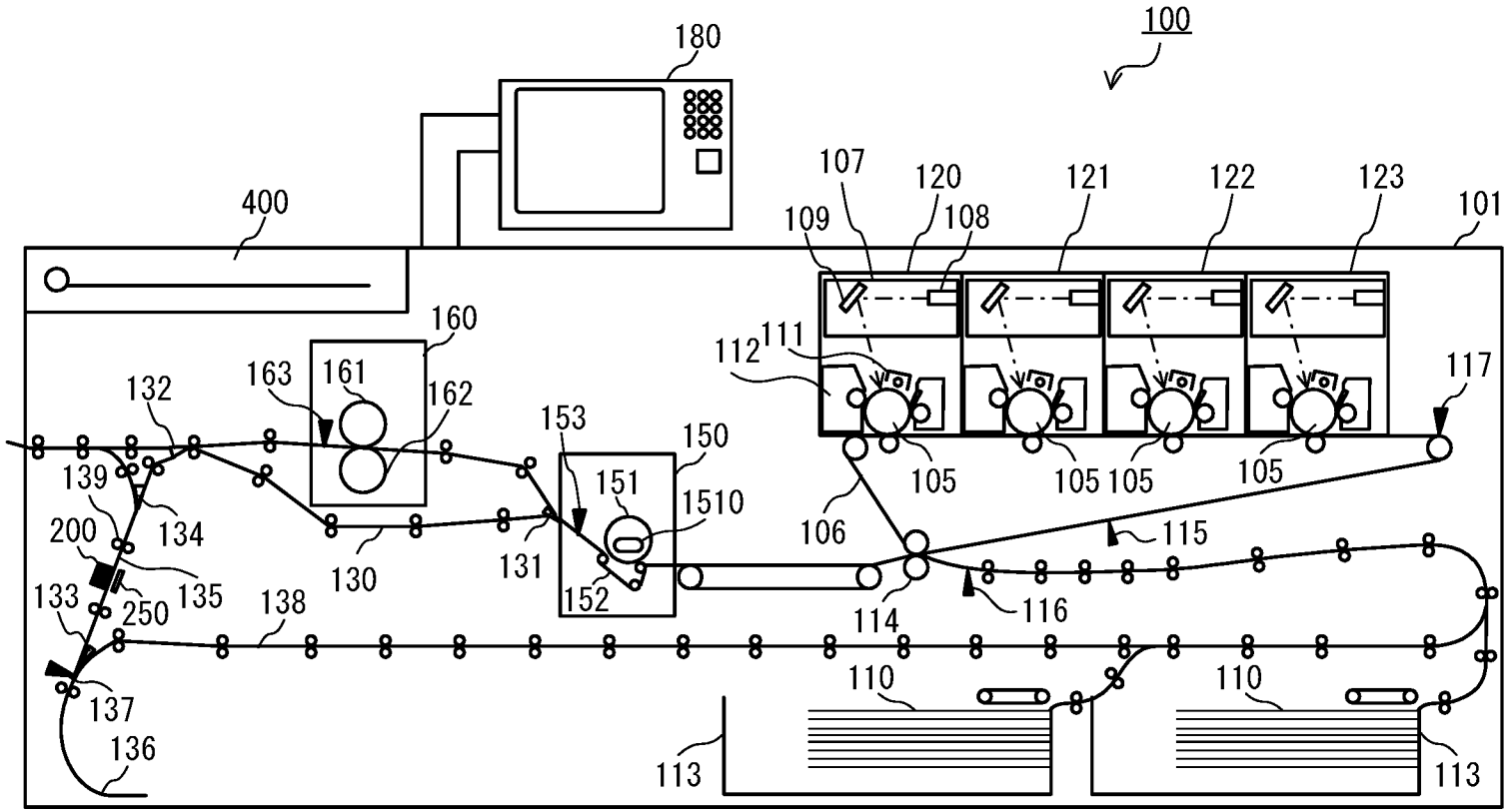
FIG. 1 is a configuration diagram of a laser beam printer in at least one embodiment of the present disclosure.

FIG. 1 is a configuration diagram of a laser beam printer (LBP) 100 being an image forming apparatus according to at least one embodiment. This LBP 100 is a printer of an electrophotographic system. The image forming apparatus according to at least one embodiment may be an ink-jet printer or a sublimation printer.

The LBP 100 includes, in a casing 101, mechanisms that form an engine unit for image formation and a controller configured to control an operation of each of the mechanisms, which is described later. An operation panel 180 and a reader 400 are provided above the casing 101. The operation panel 180 is a user interface, and includes an input device configured to receive an instruction from a user and an output device configured to display a screen, for example, an operation screen. The reader 400 is an image reading apparatus to be used for executing a copy job or a printer engine adjustment function. The respective mechanisms that form the engine unit include a mechanism for forming an image (image forming mechanism), a mechanism for transferring an image onto a recording material 110 (transferring mechanism), a mechanism for feeding the recording material 110 (feeding mechanism), and a mechanism for fixing the image to the recording material 110 (fixing mechanism).

The image forming mechanism includes four image forming units 120, 121, 122, and 123 corresponding to respective colors of yellow (Y), magenta (M), cyan (C), and black (K). The image forming units 120, 121, 122, and 123 have the same configuration except that the colors of images to be formed are different. In this case, a configuration of the image forming unit 120 is described, and descriptions of the configurations of the other image forming units 121, 122, and 123 are omitted.

The image forming unit 120 includes a photosensitive drum 105, a charger 111, a laser scanner 107, and a developing device 112. The photosensitive drum 105 is a drum-shaped photosensitive member, and is configured to rotate around a drum shaft. The charger 111 is configured to uniformly charge a surface of the rotating photosensitive drum 105. The laser scanner 107 is configured to scan the photosensitive drum 105 with laser light modulated based on image data representing an image to be formed. The laser scanner 107 includes a light emitter 108 configured to scan the laser light emitted from a semiconductor laser in one direction and a reflective mirror 109 configured to reflect the laser light from the light emitter 108 toward the photosensitive drum 105. A direction in which the laser scanner 107 scans the photosensitive drum 105 (depth direction in FIG. 1) is a main scanning direction.

The photosensitive drum 105 is charged and then scanned with the laser light, to thereby have an electrostatic latent image formed on its surface. The developing device 112 is configured to develop the electrostatic latent image formed on the photosensitive drum 105 with a developer. Therefore, an image obtained by visualizing the electrostatic latent image is formed on the surface of the photosensitive drum 105. A yellow image is formed on the photosensitive drum 105 of the image forming unit 120. A magenta image is formed on the photosensitive drum 105 of the image forming unit 121. A cyan image is formed on the photosensitive drum 105 of the image forming unit 122. A black image is formed on the photosensitive drum 105 of the image forming unit 123. The photosensitive drum 105 and the developing device 112 are detachably attachable to the casing 101.

The transferring mechanism includes an intermediate transfer member 106 and a transfer roller 114. The images are sequentially transferred onto the intermediate transfer member 106 from the respective photosensitive drums 105 of the image forming units 120, 121, 122, and 123 so as to be superimposed on one another. In at least one embodiment, the intermediate transfer member 106 rotates clockwise in FIG. 1, and the images are transferred in the order of the image forming unit 120 (yellow), the image forming unit 121 (magenta), the image forming unit 122 (cyan), and the image forming unit 123 (black). An image density detection sensor 117 for detecting image density from an image for detection of the image density, which is formed on the intermediate transfer member 106, is provided downstream of the image forming units 123 in a rotation direction of the intermediate transfer member 106.

The image transferred onto the intermediate transfer member 106 is conveyed to the transfer roller 114 in accordance with the rotation of the intermediate transfer member 106. An image formation start position detection sensor 115 for determining a transfer position onto the recording material 110 is provided upstream of the transfer roller 114 in the rotation direction of the intermediate transfer member 106. The transfer roller 114 brings the recording material 110 into pressure contact with the intermediate transfer member 106, and a bias having a characteristic opposite to that of the image on the intermediate transfer member 106 is simultaneously applied, to thereby transfer the image from the intermediate transfer member 106 onto the recording material 110.

The feeding mechanism includes sheet feeding cassettes 113 each configured to store the recording material 110, a conveyance path through which the recording material 110 is to be fed, and various rollers for conveying the recording material 110 to the conveyance path. The recording material 110 is fed from the sheet feeding cassette 113, and while being conveyed through the conveyance path, has an image transferred there on and fixed thereto. Thus, the image is formed on the recording material 110, and then the recording material 110 is delivered to the outside of the casing 101.

To that end, the recording material 110 is first fed from the sheet feeding cassette 113, and conveyed to the transfer roller 114 through the conveyance path. A sheet feeding timing sensor 116 for adjusting a conveyance timing of the recording material 110 is provided midway through the conveyance path from the sheet feeding cassette 113 to the transfer roller 114. A timing at which the recording material 110 is conveyed to the transfer roller 114 is adjusted based on a timing at which the image formation start position detection sensor 115 detects the image on the intermediate transfer member 106 and a timing at which the sheet feeding timing sensor 116 detects the recording material 110. Through this adjustment, the image is transferred from the intermediate transfer member 106 onto the recording material 110 at a predetermined position.

The recording material 110 onto which the image has been transferred is conveyed to the fixing mechanism. The fixing mechanism of the LBP 100 in at least one embodiment includes a first fixing device 150 and a second fixing device 160. In order to thermally compress the image on the recording material 110, the first fixing device 150 includes a fixing roller 151 for heating the recording material 110, a pressure belt 152 for bringing the recording material 110 into pressure contact with the fixing roller 151, and a post-fixing sensor 153 configured to detect completion of fixing. The fixing roller 151, which is a hollow roller, includes a heater 1510 inside, and is configured to convey the recording material 110 by rotating. The second fixing device 160 is arranged downstream of the first fixing device 150 in a conveying direction of the recording material 110, and is used to add gloss to the image on the recording material 110 subjected to the fixing processing by the first fixing device 150 and to ensure fixability of the image. The second fixing device 160 includes a fixing roller 161, a pressure roller 162, and a post-fixing sensor 163. The fixing roller 161 has the same configuration as that of the fixing roller 151, and functions in the same manner. The pressure roller 162 functions in the same manner as the pressure belt 152. The post-fixing sensor 163 functions in the same manner as the post-fixing sensor 153. The second fixing device 160 performs the fixing processing on the recording material 110 in the same manner as the first fixing device 150.

The second fixing device 160 may not be used depending on the type of the recording material 110 and the content of the image forming processing. A conveyance path 130 is provided in order to deliver the recording material 110 subjected to the fixing processing by the first fixing device 150 without passing the recording material 110 through the second fixing device 160. Therefore, a flapper 131 for guiding the recording material 110 to any one of the second fixing device 160 and the conveyance path 130 is provided downstream of the first fixing device 150 in the conveying direction of the recording material 110.

The recording material 110 that has passed through any one of the second fixing device 160 and the conveyance path 130 may be delivered as it is or may be conveyed to a conveyance path 135. Therefore, a flapper 132 is provided at a position at which a conveyance path following the second fixing device 160 and the conveyance path 130 merge. The flapper 132 guides the recording material 110 to any one of the conveyance path 135 and a delivery path for the recording material 110. The recording material 110, which has been guided to the delivery path, is delivered to the outside of the casing 101 while the surface on which the image has been formed faces upward.

The conveyance path 135 is a path for conveying the recording material 110 to a reverse path 136 to be used for reversing the front and back surfaces of the recording material 110. A sheet surface reverse sensor 137 configured to detect the recording material 110 is provided on the reverse path 136. When the sheet surface reverse sensor 137 detects the trailing edge of the recording material 110, the recording material 110 has the conveying direction reversed on the reverse path 136. The recording material 110 having the conveying direction reversed is conveyed to any one of the conveyance path 135 and a reverse path 138. Therefore, a flapper 133 is provided at a branch point between the conveyance path 135 and the reverse path 138. In the case of being conveyed to the conveyance path 135, the recording material 110 is guided to the conveyance path 135 by the flapper 133 to be delivered to the outside of the casing 101 with the front and back surfaces being reversed (while the surface on which the image has been formed faces downward). In the case of being conveyed to the reverse path 138, the recording material 110 is guided to the reverse path 138 by the flapper 133. The recording material 110, which has been guided to the reverse path 138, has the front and back surfaces reversed to be conveyed to the transfer roller 114 again. Thus, an image is formed on the back surface of the recording material 110.

A color detection sensor 200 configured to detect an image for detection of a correction value, which is formed on the recording material 110, is provided on the conveyance path 135. The image forming conditions are adjusted based on a detection result of the image for detection, which is obtained by the color detection sensor 200. The color detection sensor 200 is an in-line sensor capable of moving and scanning in a direction (sheet non-conveying direction) perpendicular to the conveying direction of the recording material 110. The sheet non-conveying direction is the same direction as the main scanning direction in which the laser scanner 107 scans the photosensitive drum 105. Therefore, as to 1) a main scanning direction of the color detection sensor 200 and 2) the main scanning direction in which the laser scanner 107 scans the photosensitive drum 105, these directions match each other. The conveying direction of the recording material 110 is a sub-scanning direction perpendicular to the main scanning direction. A white reference plate 250 (reference member) to be used for calibration of the color detection sensor 200 is provided at a position facing the color detection sensor 200 across the conveyance path 135.

In a case where the user uses the operation panel 180 to instruct to perform a color detection operation, the color detection sensor 200 detects the image for detection, which is formed on the recording material 110. The controller performs, based on the detection result obtained by the color detection sensor 200, main scanning unevenness correction for adjusting uniformity of the image density, automatic tone correction for maintaining the highest density and tone characteristics of a single color, and automatic color tone correction for adjusting variations of a multi-order color.

<Controller>

Figure 2:
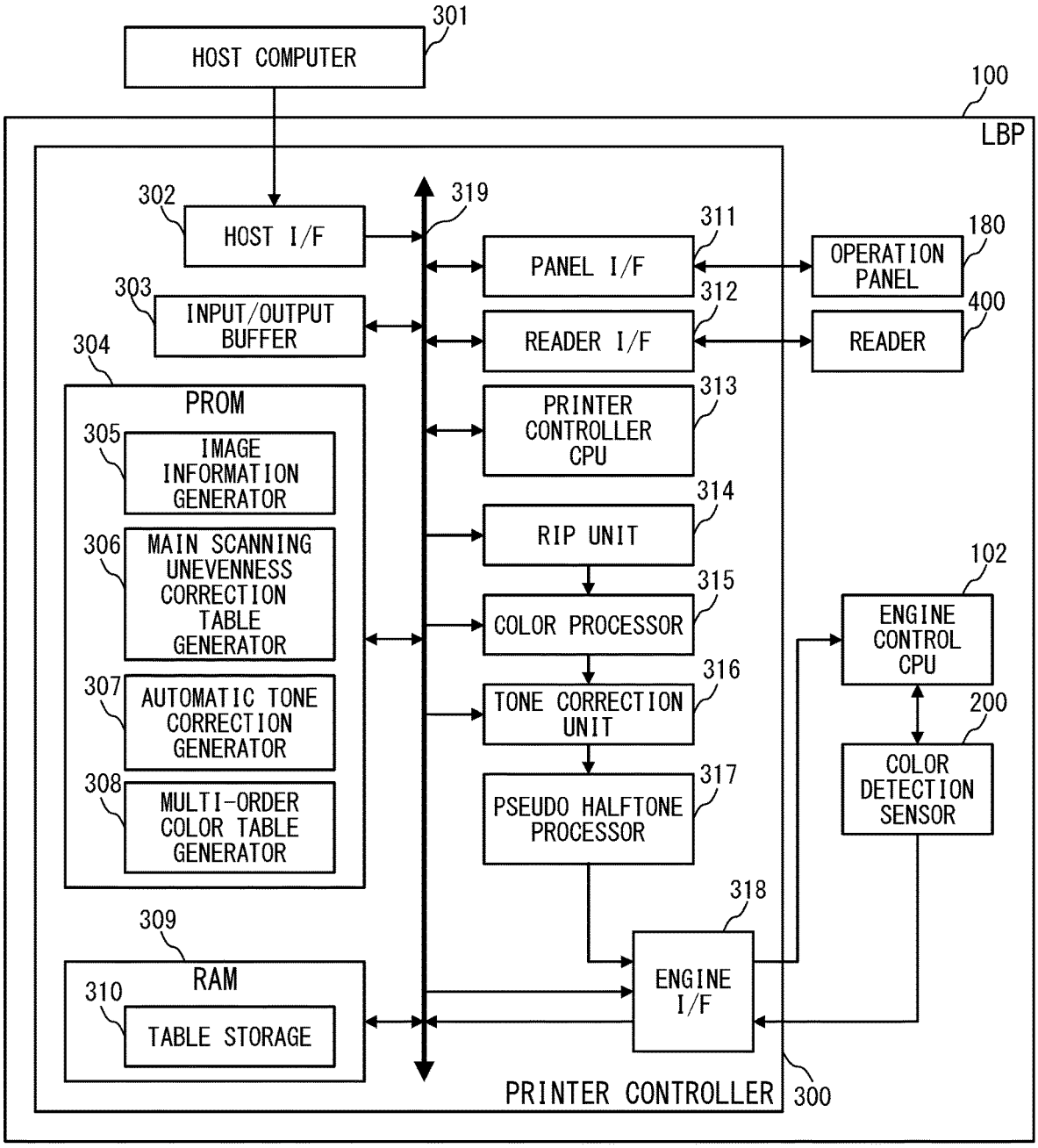
FIG. 2 is an explanatory diagram of a controller.

FIG. 2 is an explanatory diagram of the controller of the LBP 100. The LBP 100 is configured to communicate to/from the host computer 301, which is an external apparatus, in accordance with a predetermined communication protocol. The controller includes a printer controller 300 and an engine control central processing unit (CPU) 102. The printer controller 300 is configured to control an operation of the entire LBP 100. The engine control CPU 102 is configured to control the operation of each of the mechanisms that form the engine unit in accordance with an instruction from the printer controller 300.

The printer controller 300 includes a host I/F 302, a panel I/F 311, a reader I/F 312, an engine I/F 318, and an input/output buffer 303. The host I/F 302 is a communication interface with respect to the host computer 301. The panel I/F 311 is an interface with respect to the operation panel 180, and is configured to receive an instruction from the operation panel 180 and control the operation panel 180 to display a screen. The reader I/F 312 is an interface with respect to the reader 400, and is configured to acquire read data representing an image read by the reader 400. The engine I/F 318 is configured to transmit image data representing an image to be formed to the engine control CPU 102. The engine I/F 318 is also configured to acquire the detection result obtained by the color detection sensor 200. The input/output buffer 303 is configured to temporarily store a control code acquired by the host I/F 302 and various kinds of data transmitted and received by the panel I/F 311, the reader I/F 312, and the engine I/F 318.

The printer controller 300 includes a printer controller CPU 313, a programmable read only memory (PROM) 304, and a random access memory (RAM) 309. The printer controller CPU 313 is configured to control an operation of the printer controller 300. The PROM 304 is configured to store control programs to be executed by the printer controller CPU 313 and control data therefor. The printer controller CPU 313 implements different kinds of functions of the printer controller 300 by executing the control programs stored in the PROM 304. The RAM 309 is used as a work memory for calculation required in interpreting the control code and data and in performing printing or for print data processing.

The PROM 304 stores, as program modules, an image information generator 305, a main scanning unevenness correction table generator 306, an automatic tone correction generator 307, and a multi-order color table generator 308. The printer controller CPU 313 implements the respective functions by executing those program modules. The image information generator 305 is configured to generate various image objects based on settings of data received from the host computer 301. The main scanning unevenness correction table generator 306 is configured to generate a main scanning unevenness correction table indicating a relationship between density unevenness and the correction value, which is used for suppressing the density unevenness in the main scanning direction by adjusting laser light emission intensity. The automatic tone correction generator 307 is configured to generate a table (gamma look-up table (γLUT)) for performing density tone correction of a single color. The multi-order color table generator 308 is configured to generate an ICC profile being a multi-dimensional LUT in order to correct variations in multi-order color.

A table storage 310 is formed in the RAM 309. The table storage 310 is configured to store the main scanning unevenness correction table, the γLUT, and the ICC profile. In addition, the table storage 310 temporarily stores adjustment results obtained by the main scanning unevenness correction table generator 306, the automatic tone correction generator 307, and the multi-order color table generator 308.

The printer controller 300 includes a raster image processor (RIP) unit 314, a color processor 315, a tone correction unit 316, and a pseudo halftone processor 317. The RIP unit 314 is configured to expand the image object into a bitmap image. The color processor 315 performs color conversion processing for a multi-order color based on the ICC profile. The tone correction unit 316 is configured to perform tone correction of a single color through use of the γLUT. The pseudo halftone processor 317 is configured to perform pseudo halftone processing, such as dither matrix or an error diffusion method.

The respective components of the printer controller 300 are connected to one another through a system bus 319 so as to be able to transmit and receive data to/from one another. When the printer controller 300 acquires image data from the host computer 301 by the host I/F 302, the printer controller 300 processes the acquired image data by the RIP unit 314, the color processor 315, the tone correction unit 316, and the pseudo halftone processor 317. In the case of a copy job, the printer controller 300 acquires read data from the reader 400 by the reader I/F 312, and causes the RIP unit 314, the color processor 315, the tone correction unit 316, and the pseudo halftone processor 317 to perform processing to generate image data. The printer controller 300 transmits the processed image data to the engine control CPU 102 via the engine I/F 318. At this time, the printer controller 300 transmits laser light amount information corresponding to the main scanning unevenness correction table to the engine control CPU 102 via the engine I/F 318. The engine control CPU 102 controls the operation of each mechanism based on the image data and the laser light amount information to form an image corresponding to the image data on the recording material 110. The color processor 315 and the tone correction unit 316 manage and update the ICC profile, γLUT, and main scanning unevenness correction table to be used during image formation, and enable output of a desired color.

<Operation Panel>

Figure 3:
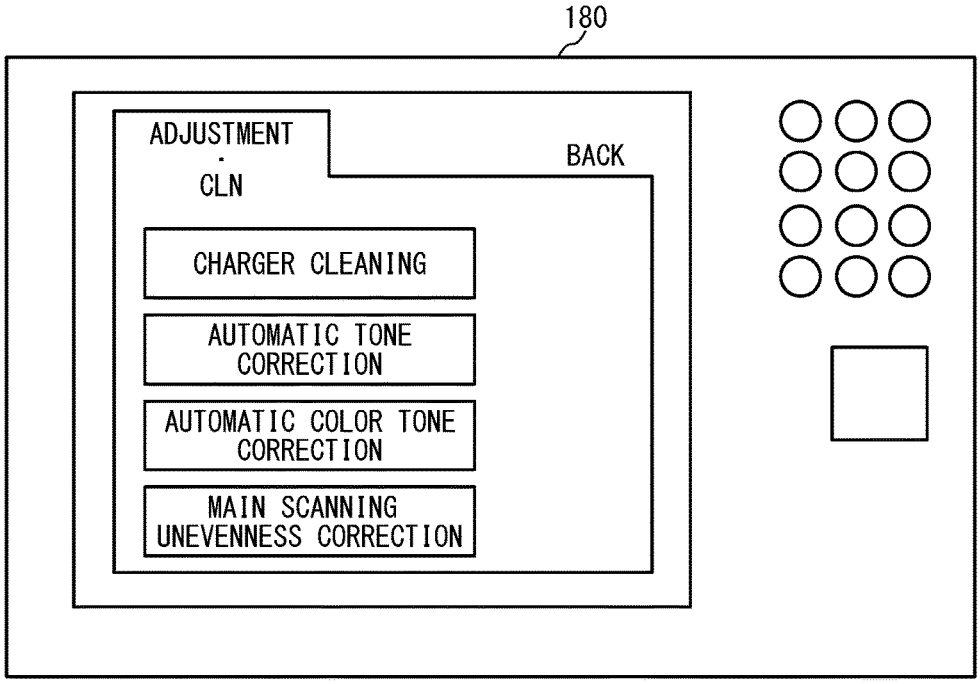
FIG. 3 is an explanatory diagram of an operation panel.

FIG. 3 is an explanatory diagram of the operation panel 180. FIG. 3 exemplifies a screen to be displayed on the operation panel 180 when the user selects a user mode called "ADJUSTMENT/CLEANING (CLN)". The adjustment mode in which an image for detection is formed on the recording material 110 to perform adjustment is an operation mode for optimizing various image forming conditions, which allows automatic tone correction, automatic color tone correction, and main scanning unevenness correction to be selected. The user selects any one of an "automatic tone correction" button, an "automatic color tone correction" button, and a "main scanning unevenness correction" button to cause the LBP 100 to perform the adjustment.

The "automatic tone correction" button, the "automatic color tone correction" button, and the "main scanning unevenness correction" button are buttons for the user to select a sheet feeding cassette ready for correction to correct the image forming conditions. In the automatic tone correction, the tone of a single color is adjusted. In the automatic color tone correction, a deviation in multi-order color that has failed to be adjusted by the automatic tone correction (for a single color) is corrected. In the main scanning unevenness correction, exposure conditions for the laser scanner 107 are corrected in order to correct the density unevenness in the main scanning direction.

<Color Detection Sensor>

Figure 4:
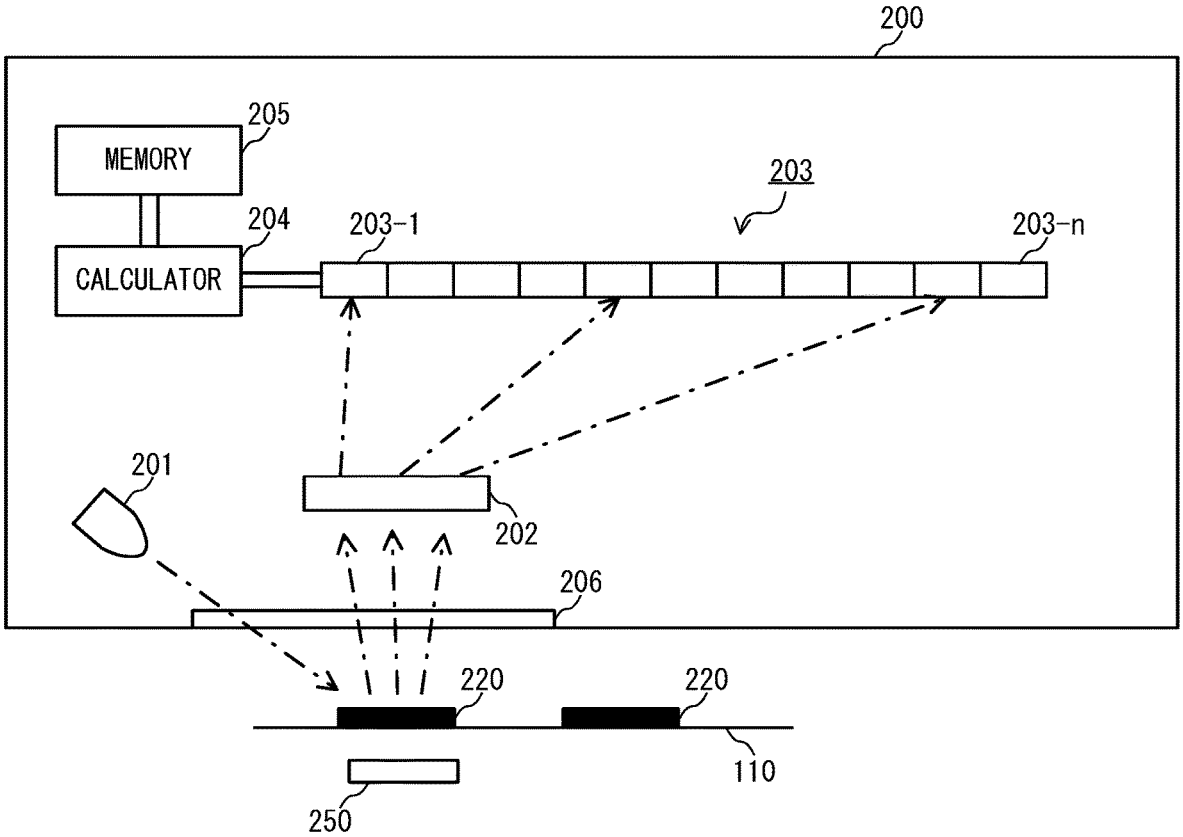
FIG. 4 is an explanatory diagram of a color detection sensor.

FIG. 4 is an explanatory diagram of the color detection sensor 200. The color detection sensor 200 detects a spectral reflectance of an image 220 for detection, which is formed on the recording material 110, to perform color measurement. The color detection sensor 200 includes a white light emitting diode (LED) 201, a diffraction grating 202, a line sensor 203, a calculator 204, a memory 205, and a lens 206.

The white LED 201 is a light-emitting unit, and is configured to apply light to the image 220 for detection on the recording material 110 conveyed through the conveyance path 135. The diffraction grating 202 is configured to spectrally disperse the light reflected by the image 220 for detection. The lens 206 is configured to condense the light emitted from the white LED 201 on the image 220 for detection, and to condense the light reflected by the image 220 for detection on the diffraction grating 202.

The line sensor 203 is a light-receiving unit having light-receiving elements 203-1 to **203-*n* corresponding to n pixels. Each of the light-receiving elements 203-1 to 203-*n* of the line sensor 203 is configured to receive the reflected light spectrally dispersed by the diffraction grating 202 for each wavelength. As a detection result, each of the light-receiving elements 203-1 to 203-*n* outputs, for example, a light intensity value representing the intensity of the received reflected light. The calculator 204 is configured to perform predetermined calculation on the light intensity value output from each of the light-receiving elements 203-1 to 203-*n*. For example, the calculator 204 performs a spectral dispersion calculation, and calculates a Lab value. The memory 205** is configured to store various kinds of data including calculation results.

The white reference plate 250 is arranged so as to be opposed to the color detection sensor 200 across the conveyance path 135 at such a position as to avoid being hidden by the recording material 110 when viewed from the color detection sensor 200, when the recording material 110 is conveyed to the conveyance path 135. The white reference plate 250 is used for adjustment of a light amount of the white LED 201 and for calibration of the color detection sensor 200, for example, white intensity standard correction. The white reference plate 250 is made of a material having high light resistance in order to suppress aging deterioration and having high strength in order to ensure attachment/detachment operation resistance. For example, a material obtained by subjecting aluminum oxide to ceramic processing is used for the white reference plate 250. The white reference plate 250 has a spectral reflectance (standard spectral reflectance data) of each wavelength measured by a reference measuring apparatus at the time of factory shipment. The color detection sensor 200 as well as the white standard plate 250 is shipped along with the measured standard spectral reflectance data. One white reference plate 250 is provided for each color detection sensor 200.

As described above, the color detection sensor 200 is capable of moving and scanning in the direction (sheet non-conveying direction) perpendicular to the conveying direction. The color detection sensor 200 and the white reference plate 250 form one pair.

In the color detection sensor 200, the calculator 204 converts the light intensity value into spectral reflectance information based on the standard spectral reflectance data. In at least one embodiment, the spectral reflectance information is detected as information of 35 bands (channels) at intervals of 10 nm in a wavelength range of from 380 nm to 720 nm. The color detection sensor 200 transmits the spectral reflectance information to the printer controller 300 as a detection result.

The printer controller 300 performs processing for, for example, the main scanning unevenness correction, the automatic tone correction, and the automatic color tone correction based on the spectral reflectance information. The printer controller 300 uses a known status A filter or a visual filter to perform the main scanning unevenness correction and the automatic tone correction based on the density value of the image for detection, which has been calculated from the spectral reflectance information.

The printer controller 300 grasps the unevenness in the main scanning direction based on the density value by performing the main scanning unevenness correction, and creates a main scanning unevenness correction table for correcting the output (power) of the laser light to be emitted when the photosensitive drum 105 is scanned so as to suppress the density unevenness in the main scanning direction.

The printer controller 300 generates such a γLUT as to cause the output density to reach a defined tone target based on the detection result of the image for detection by the automatic tone correction. During normal image formation, the image data is converted through use of this γLUT to perform tone correction.

The printer controller 300 converts the spectral reflectance information into CIE L*a*b* through use of a color matching function, which is a conversion method of ISO 13655, and a standard light source D50, and uses the converted spectral reflectance information for the automatic color tone correction. Through the automatic color tone correction, an ICC profile, which is a multi-dimensional LUT, is created.

<Main Scanning Unevenness Correction>

Figure 5:
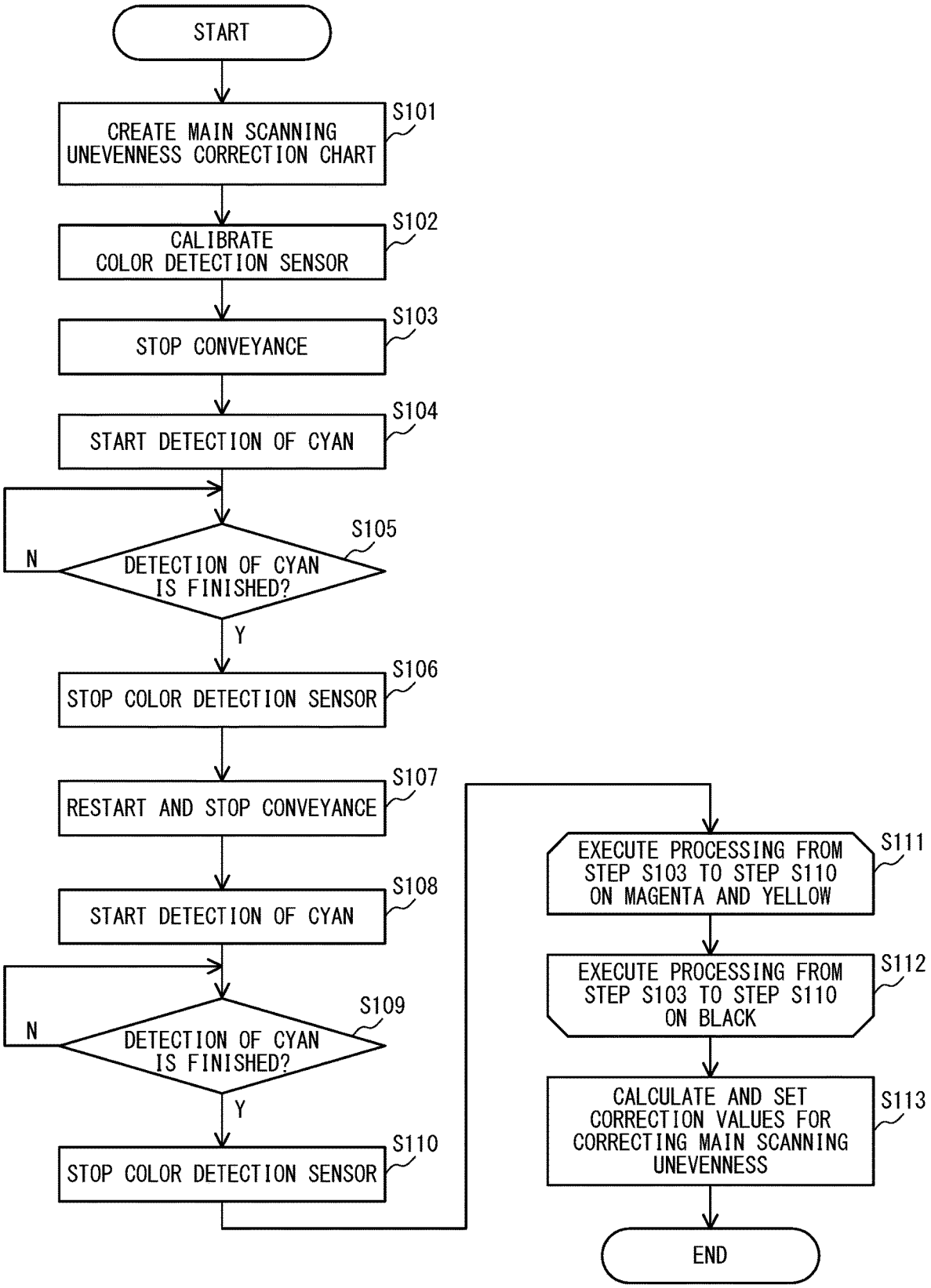
FIG. 5 is a flow chart for illustrating main scanning unevenness correction processing.

FIG. 5 is a flow chart for illustrating main scanning unevenness correction processing. When the user selects the "main scanning unevenness correction" button on the operation panel 180, the printer controller CPU 313 receives an instruction to execute the main scanning unevenness correction. When receiving the instruction to execute the main scanning unevenness correction, the printer controller CPU 313 instructs the engine control CPU 102 to execute the main scanning unevenness correction. The engine control CPU 102 starts the main scanning unevenness correction processing when instructed to execute the main scanning unevenness correction by the printer controller CPU 313.

The engine control CPU 102 forms an image for detection of main scanning unevenness on the recording material 110, to thereby create a main scanning unevenness correction chart (Step S101). The main scanning unevenness correction chart is conveyed to a detection position of the color detection sensor 200 along the conveyance path 135 by conveyance rollers 139.

Figure 6:
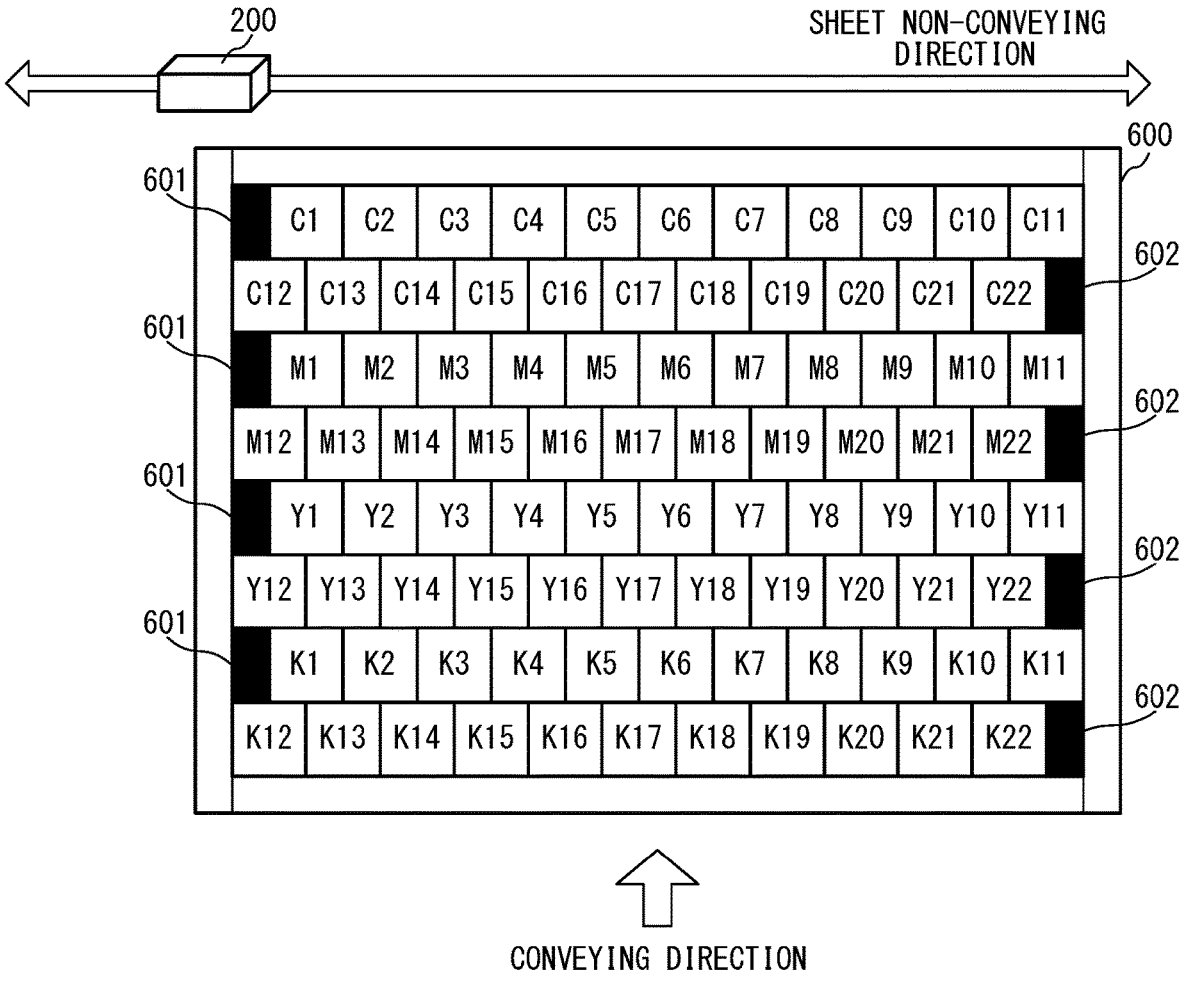
FIG. 6 is an explanatory diagram of a main scanning unevenness correction chart.

FIG. 6 is an explanatory diagram of the main scanning unevenness correction chart. A main scanning unevenness correction chart 600 is formed by printing an image for detection, which includes a combination of 22 patch images for each color, on the recording material 110. The image for detection includes two patch image sequences formed in two rows in the conveying direction of the recording material 110 (sub-scanning direction) for each color. The two patch image sequences each have a plurality of (in at least one embodiment, 11) patch images arrayed in the sheet non-conveying direction (main scanning direction). A (first-row) patch image sequence having 11 patch images on the upstream side in the conveying direction and a (second-row) patch image sequence having 11 patch images on the downstream side in the conveying direction are arranged by being shifted from each other in the sheet non-conveying direction. In at least one embodiment, the first-row patch image sequence and the second-row patch image sequence are shifted by ½ of the size of one patch image in the sheet non-conveying direction, and the 22 patch images are arranged in a staggered pattern. In FIG. 6, black trigger bars 601 and 602 are arranged at the left end of the first-row patch image sequence and the right end of the second-row patch image sequence, respectively. The trigger bars 601 and 602 are reference images serving as references for detection timings of the first-row patch image sequence and the second-row patch image sequence, respectively. The first-row patch image sequence is detected with the detection timing of the trigger bar 601 being used as a reference, and the second-row patch image sequence is detected with the detection timing of the trigger bar 602 being used as a reference. The image for detection is formed in a rectangular shape as a whole by including the 22 patch images of each color and the trigger bars 601 and 602. In at least one embodiment, the patch images of the respective colors are arranged in the order of cyan, magenta, yellow, and black from the upstream side in the conveying direction of the recording material 110.

The color detection sensor 200 detects the white reference plate 250 before the detection of the image for detection. The printer controller CPU 313 performs calibration including light amount correction of the color detection sensor 200 and spectral reflectance correction of a detection value based on the detection result of the white reference plate 250 (Step S102). When the calibration of the color detection sensor 200 is finished, the engine control CPU 102 conveys the main scanning unevenness correction chart 600 until patch images C1 to C11 in the first row of cyan reach the detection position of the color detection sensor 200, and then stops the recording material 110 (Step S103).

When the recording material 110 is stopped, the engine control CPU 102 moves the color detection sensor 200 in the sheet non-conveying direction to start the detection of the patch images C1 to C11 of cyan (Step S104). The color detection sensor 200 starts to perform the color measurement of the patch images C1 to C11 with the trigger bar 601 being used as a reference. When the detection of the patch images C1 to C11 of cyan is finished (Y in Step S105), the engine control CPU 102 stops moving the color detection sensor 200 (Step S106). Through the processing from Step S104 to Step S106, the detection of the patch images C1 to C11 in the first row of cyan is finished.

When the detection of the patch images C1 to C11 in the first row of cyan is finished, the engine control CPU 102 conveys the main scanning unevenness correction chart 600 until patch images C12 to C22 in the second row of cyan reach the detection position of the color detection sensor 200, and then stops the recording material 110 (Step S107). When the recording material 110 is stopped, the engine control CPU 102 moves the color detection sensor 200 in the sheet non-conveying direction to start the detection of the patch images C22 to C12 in the second row of cyan (Step S108). The color detection sensor 200 starts to perform the color measurement of the patch images C22 to C12 with the trigger bar 602 being used as a reference. When the detection of the patch images C22 to C12 of cyan is finished (Y in Step S109), the engine control CPU 102 stops moving the color detection sensor 200 (Step S110). Through the processing from Step S108 to Step S110, the detection of the patch images C12 to C22 in the second row of cyan is finished.

In this manner, the color detection sensor 200 detects the 22 patch images C1 to C22 of cyan through reciprocation in the sheet non-conveying direction. The color detection sensor 200 detects the patch images C1 to C11 in the first row on an outward path, and detects the patch images C12 to C22 in the second row on a return path. The engine control CPU 102 similarly detects patch images M1 to M22 of magenta, patch images Y1 to Y22 of yellow, and patch images K1 to K22 of black through the reciprocation of the color detection sensor 200 (Step S111 and Step S112).

The main scanning unevenness correction table generator 306 creates a main scanning unevenness correction table based on the detection results of the 22 patch images of each color. The main scanning unevenness correction table generator 306 converts the detection results from the spectral reflectance information into density in accordance with an ISO 5-3 density calculation method. The detection results of the patch images of yellow, magenta, and cyan are each converted into a status A density. The detection result of the patch image of black is converted into a visual density. The main scanning unevenness correction table generator 306 creates a main scanning unevenness correction table including correction values for correcting the main scanning unevenness based on the detected density values of the respective colors. The printer controller CPU 313 generates such laser light amount information as to correct the main scanning unevenness based on the correction values in the main scanning unevenness correction table, and notifies the engine control CPU 102 of the laser light amount information. The engine control CPU 102 sets the laser light amount information in preparation for image formation to be performed for the next and subsequent times (Step S113). In this manner, the main scanning unevenness correction processing is performed.

<Main Scanning Unevenness Correction Chart>

In the main scanning unevenness correction chart 600 in at least one embodiment, which is exemplified in FIG. 6, the density value of each patch image is determined in a range from highlight with high user sensitivity to halftone (for example, 40%). The density value may be changeable depending on the density to which the user attaches great importance. In addition, as described above, the patch images of each color are arranged in two rows in a staggered pattern. The trigger bar 601 and the trigger bar 602 are arranged at different positions in the main scanning direction. With such a main scanning unevenness correction chart, the image density at the position of the trigger bar 601 can be detected by the patch image (for example, C12) at the left end of the second row, and the image density at the position of the trigger bar 602 can be detected by the patch image (for example, C11) at the right end of the first row. Such an arrangement allows the main scanning unevenness to be detected up to the end portions of the main scanning unevenness correction chart 600 in the main scanning direction, to thereby be able to correct the image forming conditions with high accuracy.

Figure 7:
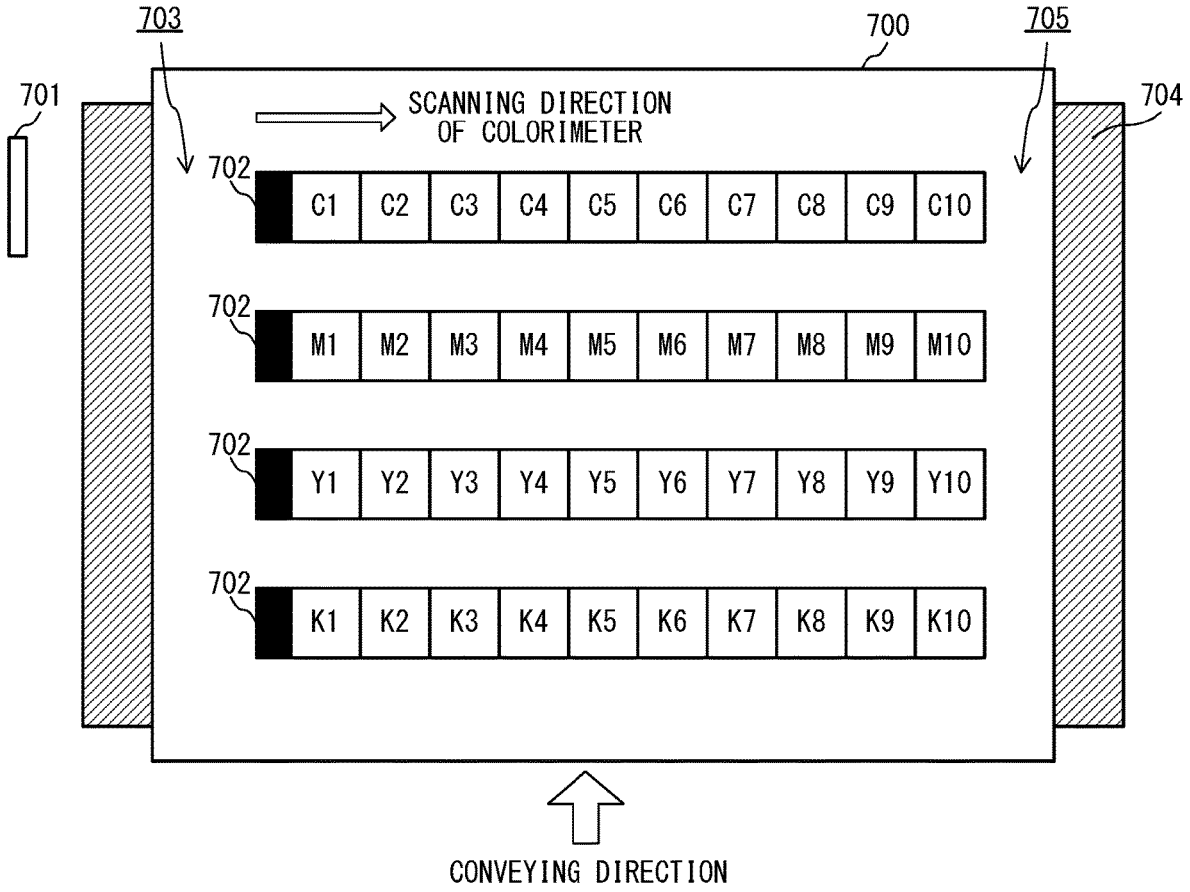
FIG. 7 (PRIOR ART)
FIG. 7 is an exemplary diagram for illustrating a related-art main scanning unevenness correction chart.

For the sake of comparison, FIG. 7 exemplifies a related-art main scanning unevenness correction chart. A main scanning unevenness correction chart 700 illustrated in FIG. 7 includes an image for detection in which patch image sequences of the respective colors are arranged row by row for each color in the sheet non-conveying direction. A trigger bar 702 is provided at the left end of the patch image sequence of each color. A colorimeter 701 of a manual scanning type is arranged on the left side of the main scanning unevenness correction chart 700. A user scans the main scanning unevenness correction chart 700 by gripping the colorimeter 701 and moving the colorimeter 701 to the right side, to thereby perform the color measurement of each patch image.

A structure in which the trigger bar 702 is provided is the same as that of the main scanning unevenness correction chart 600 in at least one embodiment. However, when the color measurement is performed by the colorimeter 701, which is used in an offline environment, a fixed amount of a non-printing area (margin area 703) is required before the trigger bar 702 is read. It is possible to select, for example, white, black, or gray for a backing member 704 for the main scanning unevenness correction chart 700. The colorimeter 701 is required to be capable of performing the color measurement of the backing member 704 of any color.

Therefore, the colorimeter 701 used offline is brought into contact with the margin area 703 of the main scanning unevenness correction chart 700 without being brought into contact with the backing member 704, and then starts scanning to control the timing of the color measurement by the trigger bar 702. In this case, when the backing member 704 is black, the following problem occurs. That is, when the user starts scanning after bringing the colorimeter 701 into contact with the black backing member 704, the colorimeter 701 determines that the backing member 704 is the trigger bar 702, and starts to perform the color measurement from the backing member 704 instead of the patch image.

In addition, the user moves the colorimeter 701 by hand, and hence there are variations in scanning speed of the colorimeter 701. In order to reliably detect the trigger bar 702, it is required to provide room to the margin area 703 in consideration of a time period from the start of scanning until the detection of the trigger bar 702 and a measured diameter of the colorimeter 701.

It is also required to provide a wide non-printing area (margin area 705) after the detection of the patch image in order to stop an operation of the colorimeter 701. This is because the colorimeter 701 determines that the scanning is finished when a state in which the reflectance is high continues for a predetermined time period after the color measurement of a defined number of patch images is finished.

As described above, when the color measurement of the main scanning unevenness correction chart 700 is performed through use of the manual colorimeter 701 illustrated in FIG. 7, it is required to provide the main scanning unevenness correction chart 700 with a wider margin area in the main scanning direction than that of the main scanning unevenness correction chart 600 illustrated in FIG. 6. Therefore, it is difficult for the colorimeter 701 to perform the color measurement up to the end portion of the main scanning unevenness correction chart 700. As a result, when the manual colorimeter 701 is used to perform the color measurement of the main scanning unevenness correction chart 700, it is difficult to correct unevenness at both end portions in the main scanning direction with high accuracy.

In at least one embodiment, it is possible to correct unevenness at the both end portions in the main scanning direction with high accuracy through use of the color detection sensor 200, which is an in-line sensor configured to perform scanning with the sheet non-conveying direction being set as the main scanning direction, and the main scanning unevenness correction chart 600, in which patch images are arranged in a staggered pattern.

In the patch images C1 to C11 in the first row of cyan of the main scanning unevenness correction chart 600, the trigger bar 601 is arranged at the position determined on the assumption that the color detection sensor 200 performs scanning from left to right. In the same manner, in the patch images C12 to C22 of the second row of cyan, the trigger bar 602 is arranged at the position determined on the assumption that the color detection sensor 200 performs scanning from right to left. The trigger bars 601 and 602 are patch images for controlling the color measurement start timing of the color detection sensor 200, and are therefore required to be detected immediately before detection of a patch image for color measurement.

Therefore, it is required to determine in advance the main scanning direction of the color detection sensor 200 and the positions of the trigger bars 601 and 602 in the main scanning unevenness correction chart 600. In addition, when an in-line sensor is used as the color detection sensor 200, a relationship between the main scanning unevenness correction chart 600 and a color measurement operation of the color detection sensor 200 is satisfactory.

As long as the color of a backing member of the main scanning unevenness correction chart 600 is white, the color of the backing member is prevented from being confused with the trigger bars 601 and 602, and the contrast can be ensured as well. However, as described in regard to the offline colorimeter 701, the backing member is changed in some cases. In the main scanning unevenness correction chart 600 of FIG. 6, even in the case of a black backing member, when the color detection sensor 200 starts to perform the color measurement by detecting black, white, and black at predetermined timings in the stated order, a related-art problem does not occur. In the same manner, even in the case of a gray backing member, when the color detection sensor 200 starts to perform the color measurement by detecting gray, white, and black at predetermined timings in the stated order, a related-art problem does not occur. What is important is to be able to determine whether or not the backing member is being detected at a wavelength and intensity that can be detected by the color detection sensor 200. Through the changing of conditions at the times of detecting the trigger bars 601 and 602, it is possible to perform the color measurement even with a margin portion of even about 2.5 mm while the offline sensor requires a margin portion of about 20 mm.

In a mechanism in which the backing member is unchangeable, it is sufficient to register only that state. Meanwhile, in a configuration in which the backing member is changeable, it is sufficient to automatically detect and register the color of the backing member when the backing member is changed. With the color detection sensor 200 in at least one embodiment, spectral reflectance information on a visible light region can be obtained, and hence a wide range of colors of backing members can be handled. Therefore, even when the user changes backing conditions, the color detection sensor 200 can perform the color measurement of the main scanning unevenness correction chart 600 of FIG. 6.

Figure 8:
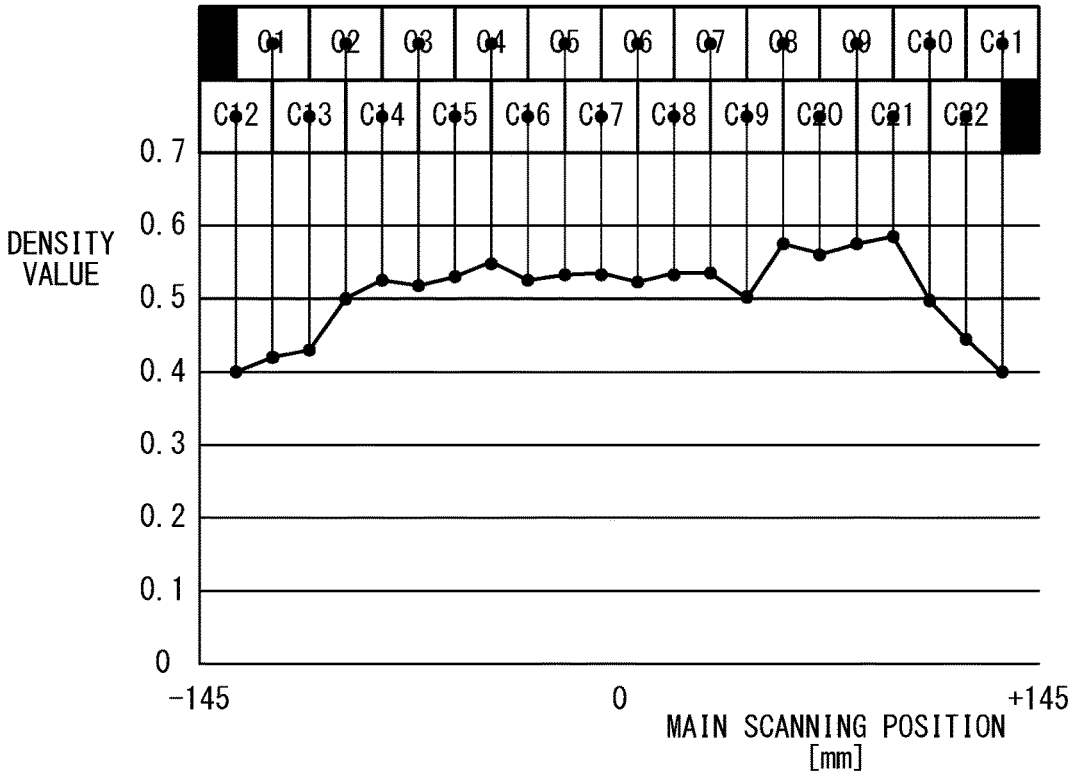
FIG. 8 is an explanatory diagram of a density value at each main scanning position.

FIG. 8 is an explanatory diagram of density values at respective positions (main scanning positions) in the main scanning direction, which are obtained from the detection results of the main scanning unevenness correction chart 600 of FIG. 6. The printer controller CPU 313 calculates the main scanning unevenness correction table so that the density value at each main scanning position, which is obtained from the detection result obtained by the color detection sensor 200, becomes a main scanning average density value, and transmits the main scanning unevenness correction table to the engine control CPU 102. The main scanning unevenness correction table is laser light amount correction profile information for correcting, for each main scanning position, the light amount of the laser light to be output from the laser scanner 107.

In the printer controller 300, information (LPW-density curve) indicating a relationship between the laser light amount of the laser scanner 107 and image density on the recording material 110, which is exhibited when the density value is 40%, is registered in advance. The printer controller CPU 313 refers to the LPW-density curve to calculate such laser light amount correction profile information that the density value at each main scanning position becomes the main scanning average density value, and creates a main scanning unevenness correction table.

The laser light amount correction profile information is prepared for each of 25 division blocks in the main scanning direction. When one block has a size of 13.2 mm, the laser light amount correction profile information enables density correction with a width of 330 mm. In this case, it is possible to achieve image formation with high image quality by adjusting the image forming conditions for the recording material 110 in A3 size. The laser light amount correction profile information among the 25 division blocks can avoid a difference in level between blocks through interpolation processing.

Figure 9:
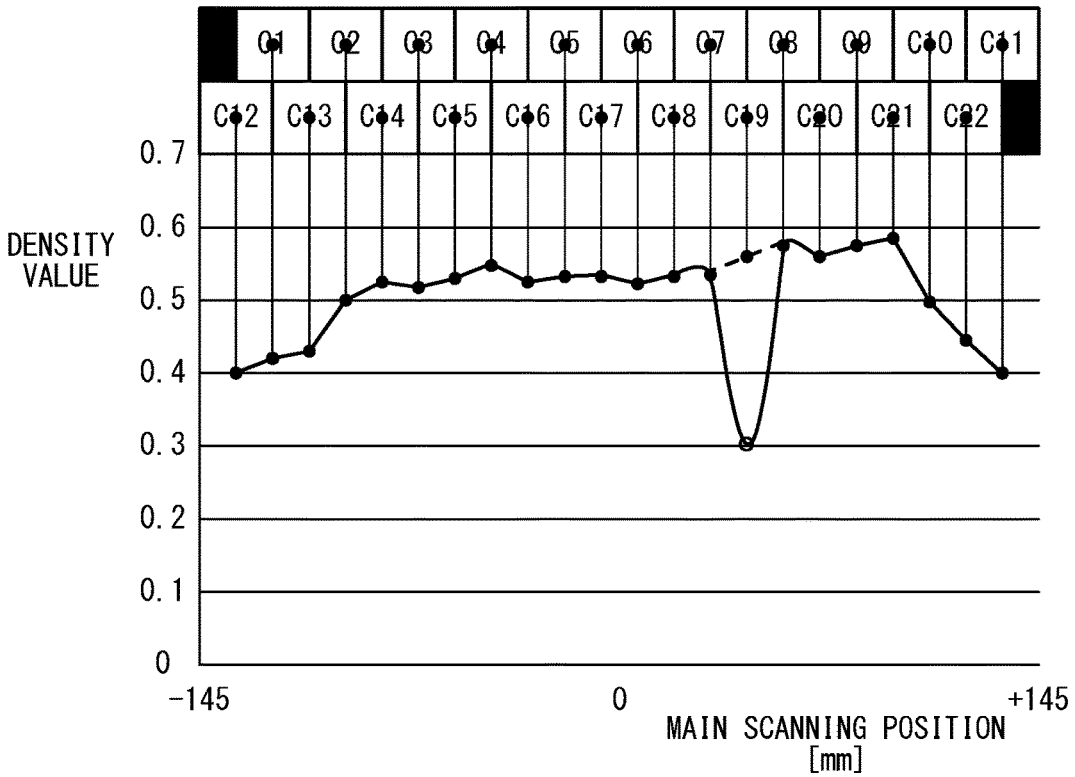
FIG. 9 is an explanatory diagram of a density value at each main scanning position exhibited in a case where an image failure occurs.

In the LBP 100, an image failure, for example, a streak image, may be temporarily generated due to, for example, adhesion of foreign particles to the charger 111 or the laser scanner 107 or a sleeve coating failure caused by intrusion of foreign matter into the developing device 112. FIG. 9 is an explanatory diagram of density values at respective main scanning positions, which are obtained from the detection results of the main scanning unevenness correction chart 600 when an image failure occurs.

In FIG. 9, an image failure has occurred in the patch image C19, and the detected density value of the patch image C19 is as low as about 0.3. In such a case, the printer controller CPU 313 examines differences between the detected density value of a given patch image and those of the adjacent blocks in the main scanning direction, and determines whether or not the detected density value of the given patch image can be used for the correction calculation of the main scanning unevenness. For example, when a difference ΔD is equal to or larger than 0.2, the printer controller CPU 313 determines that an image failure has occurred in the given patch image, and the correction calculation is performed through use of the density values of the adjacent patch images instead of using the density value of the given patch image for the correction calculation. When an image failure has occurred in the patch image C19, the printer controller CPU 313 interpolates the density value of the patch image C19 by performing interpolation calculation from the density values of the patch images C7 and C8, which are adjacent to the patch image C19 in the main scanning direction, as indicated by the dotted line.

It is a general technology to thus delete the detection result obtained at the occurrence position of an image failure for interpolation based on the detection results obtained at the adjacent positions. However, in at least one embodiment, the patch images are arranged in two rows in a staggered pattern, and the interpolation is performed based on the detection results of the patch images, to thereby increase the resolution due to an increased number of blocks in the main scanning direction. Therefore, the accuracy of the interpolation calculation becomes higher.

<Modification Example of Main Scanning Unevenness Correction Chart>

Figure 10:
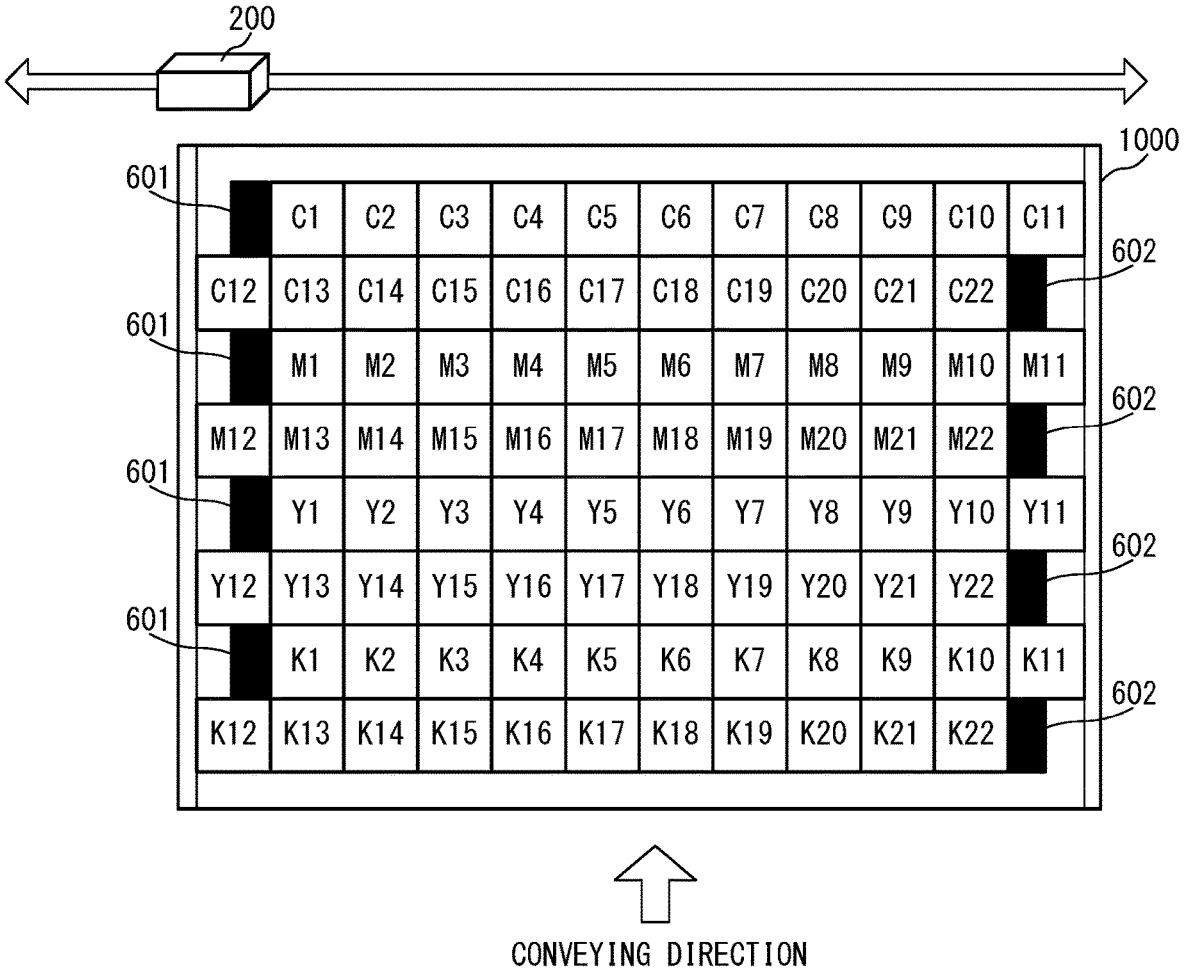
FIG. 10 is an explanatory diagram of another main scanning unevenness correction chart.

FIG. 10 is an explanatory diagram of another main scanning unevenness correction chart. In the main scanning unevenness correction chart 600 of FIG. 6, the patch images are arranged in a staggered pattern, while in a main scanning unevenness correction chart 1000 of FIG. 10, the patch images are arranged in a lattice pattern. That is, the first-row patch image sequence and the second-row patch image sequence are shifted by the size of one patch image in the sheet non-conveying direction.

As described with reference to FIG. 7, when the backing member 704 is black, the image for detection may not be accurately detected. Therefore, in the configuration of FIG. 6, the white backing member is used with the patch images arranged in a staggered pattern, and the trigger bars 601 and 602 are arranged at the end portions of the recording material 110.

It is desired that the user be able to change the backing member depending on the purpose even when an in-line sensor is used to detect the image for detection. When a color measurement mode is executed by detecting a black backing member with an in-line sensor, it is difficult to issue a reliable trigger due to, for example, the skew feeding of the main scanning unevenness correction chart, the size of its margin, the movement accuracy of the in-line sensor, or an individual difference of the in-line sensor.

For a reliable trigger, the main scanning unevenness correction chart 1000 has the trigger bars 601 and 602 arranged at inner positions as compared to those of the main scanning unevenness correction chart 600 of FIG. 6. That is, a margin area up to a position at which each of the trigger bars 601 and 602 is detected is increased as compared to that of the main scanning unevenness correction chart 600. In the main scanning unevenness correction chart 1000, the density is detected by the second-row patch image sequence. The patch images of the main scanning unevenness correction chart 1000 may be arranged in a staggered pattern in the same manner as those of the main scanning unevenness correction chart 600.

As described above, it is possible to detect the image density up to the end portions of the recording material 110 in the main scanning direction in any of the main scanning unevenness correction charts 600 and 1000 illustrated as examples. When the image density can be detected up to the end portions of the recording material 110, the number of patch images can be increased as compared to a related art. When an ICC profile is created, 1,617 patch images are used, and hence the image for detection capable of increasing the patch images as compared to the related art can contribute to the reduction in number of main scanning unevenness correction charts.

As described above, through use of the main scanning unevenness correction charts 600 and 1000 in at least one embodiment, it is possible to detect the density unevenness even at the main scanning position at which a trigger bar is arranged, and thus automatically perform the main scanning unevenness correction with high accuracy. In at least one embodiment, the case of correcting the image density has been described, but such arrangements of the patch images and the trigger bars as in the main scanning unevenness correction charts 600 and 1000 are also effective for an image for detection to be used for correcting other image forming conditions. Accordingly, it is possible to correct the image forming conditions with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-121631, filed Jun. 28, 2019, which is hereby incorporated by reference herein in its entirety.

What is claimed is:

1. An image forming apparatus, comprising:

an image forming unit configured to form an image on a sheet based on an image forming condition;

a conveyance unit configured to convey the sheet;

a sensor configured to move in a direction perpendicular to a conveying direction in which the conveyance unit conveys the sheet, and to read the image on the sheet; and a controller configured to:

control the image forming unit to form a first trigger image, a second trigger image, a first pattern image, and a second pattern image on the sheet, a position in the conveying direction where the first trigger image and the first pattern image are positioned on the sheet being different from a position in the conveying direction where the second trigger image and the second pattern image are positioned on the sheet, with the first trigger image being used for controlling a timing at which the sensor reads the first pattern image, and the second trigger image being used for controlling a timing at which the sensor reads the second pattern;

control the conveyance unit to convey the sheet;

execute a first scan in which the sensor reads the first trigger image and the first pattern image, the sensor moving in a first direction perpendicular to the conveying direction in the first scan;

execute a second scan in which the sensor reads the second trigger image and the second pattern image, the sensor moving in a second direction opposite to the first direction perpendicular to the conveying direction in the second scan; and generate the image forming condition based on reading results of the first pattern image and the second pattern by the sensor, wherein the first trigger image is formed upstream of the first pattern image in the first direction, wherein, in the direction perpendicular to the conveying direction, a formation area in which the first trigger image is formed on the sheet overlaps with a formation area in which the second pattern image is formed on the sheet, wherein the second trigger image is formed upstream of the second pattern image in the second direction, and wherein, in the direction perpendicular to the conveying direction, a formation area in which the second trigger image is formed on the sheet overlaps with a formation area in which the first pattern image is formed on the sheet.

2. The image forming apparatus according to claim 1, wherein the first trigger image has a predetermined color, and wherein the second trigger image has the predetermined color.

3. The image forming apparatus according to claim 1, wherein the controller is configured to control the conveyance unit to stop conveying the sheet during a period in which the first scan is being executed, and wherein the controller is configured to control the conveyance unit to stop conveying the sheet during a period in which the second scan is being executed.

4. The image forming apparatus according to claim 1, wherein the image forming condition includes a condition for correcting unevenness of density of an image to be formed, in the direction perpendicular to the conveying direction.

5. The image forming apparatus according to claim 1, wherein the first pattern image includes one first patch image and another first patch image, and wherein a width of the first trigger image in the direction perpendicular to the conveying direction is shorter than a width of the one first patch image in the direction perpendicular to the conveying direction.

6. The image forming apparatus according to claim 1, wherein the first pattern image includes one first patch image and another first patch image, wherein the second pattern image is formed by being offset by a predetermined length in the direction perpendicular to the conveying direction, and wherein the predetermined length is shorter than a length of the one first patch image in the direction perpendicular to the conveying direction.

7. The image forming apparatus according to claim 1, wherein the first trigger image and the second trigger have a predetermined color, wherein the first pattern image has a first color different from the predetermined color, and wherein the second image has a second color different from the predetermined color.

8. An image forming apparatus, comprising:

an image forming unit configured to form an image on a sheet based on an image forming condition;

a conveyance unit configured to convey the sheet;

a sensor configured to move in a direction perpendicular to a conveying direction in which the conveyance unit conveys the sheet, and read the image on the sheet; and a controller configured to:

control the image forming unit to form a first trigger image, a second trigger image, a first pattern image, and a second pattern image on the sheet, a position in the conveying direction where the first trigger image and the first pattern image are positioned on the sheet being different from a position in the conveying direction where the second trigger image and the second pattern image are positioned on the sheet, with the first trigger image being used for controlling a timing at which the sensor reads the first pattern image, and the second trigger image being used for controlling a timing at which the sensor reads the second pattern image;

control the conveyance unit to convey the sheet to read the first trigger image and the first pattern image on the sheet by the sensor;

execute a first scan in which the sensor reads the first trigger image and the first pattern image, the sensor moving in a first way of the direction perpendicular to the conveying direction in the first scan;

control the conveyance unit to convey the sheet to read the second trigger image and the second pattern image on the sheet by the sensor;

execute a second scan in which the sensor reads the second trigger image and the second pattern image, the sensor moving in a second way opposite to the first way of the direction perpendicular to the conveying direction in the second scan; and generate the image forming condition based on reading results of the first pattern image and the second pattern image by the sensor, wherein the first trigger image is formed at a position different from a position of the first pattern image in the direction perpendicular to the conveying direction, wherein, in the direction perpendicular to the conveying direction, a formation area in which the first trigger image is formed on the sheet overlaps with a formation area in which the second pattern image is formed on the sheet, wherein the second trigger image is formed at a position different from a position of the second pattern image in the direction perpendicular to the conveying direction, and wherein, in the direction perpendicular to the conveying direction, a formation area in which the second trigger image is formed on the sheet overlaps with a formation area in which the first pattern image is formed on the sheet.

9. The image forming apparatus according to claim 8, wherein the first trigger image has a predetermined color, and wherein the second trigger image has the predetermined color.

10. The image forming apparatus according to claim 8, wherein the first trigger image and the second trigger have a predetermined color, wherein the first pattern image has a first color different from the predetermined color, and wherein the second image has a second color different from the predetermined color.

11. The image forming apparatus according to claim 8, wherein the controller is configured to control the conveyance unit to stop conveying the sheet during a period in which the first scan is being executed, and wherein the controller is configured to control the conveyance unit to stop conveying the sheet during a period in which the second scan is being executed.

12. The image forming apparatus according to claim 8, wherein the image forming condition includes a condition for correcting unevenness of density of an image to be formed, in the direction perpendicular to the conveying direction.

13. The image forming apparatus according to claim 8, wherein the first pattern image includes one first patch image and another first patch image, and wherein a width of the first trigger image in the direction perpendicular to the conveying direction is shorter than a width of the one first patch image in the direction perpendicular to the conveying direction.

14. The image forming apparatus according to claim 8, wherein the first pattern image includes one first patch image and another first patch image, wherein the second pattern image is formed by being offset by a predetermined length in the direction perpendicular to the conveying direction, and wherein the predetermined length is shorter than a length of the one first patch image in the direction perpendicular to the conveying direction.

* * * * *